US007849782B2

(12) United States Patent
Heldmann

(10) Patent No.: US 7,849,782 B2
(45) Date of Patent: Dec. 14, 2010

(54) LARGE-CALIBER GUN INTEGRATED INTO A MILITARY SHIP

(75) Inventor: Heinrich Heldmann, Kassel (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 588 days.

(21) Appl. No.: 11/850,203

(22) Filed: Sep. 5, 2007

(65) Prior Publication Data

US 2010/0263526 A1 Oct. 21, 2010

(30) Foreign Application Priority Data

Sep. 5, 2006 (DE) ..... 10 2006 041 602

(51) Int. Cl.
*F41A 9/00* (2006.01)

(52) U.S. Cl. ..... 89/46

(58) Field of Classification Search ..... 89/46
See application file for complete search history.

(56) References Cited

U.S. PATENT DOCUMENTS

| | | | | | |
|---|---|---|---|---|---|
| 3,136,214 | A * | 6/1964 | Girouard et al. | ..... | 89/36.13 |
| 4,777,863 | A * | 10/1988 | De Haven et al. | ..... | 89/33.1 |
| 4,823,675 | A * | 4/1989 | Schiele et al. | ..... | 89/46 |
| 4,947,728 | A * | 8/1990 | Muhlhausen et al. | ..... | 89/46 |
| 4,998,458 | A * | 3/1991 | Schiele et al. | ..... | 89/46 |
| 5,196,643 | A * | 3/1993 | Jorg et al. | ..... | 89/46 |
| 5,844,163 | A * | 12/1998 | Lindskog | ..... | 89/46 |
| 6,679,159 | B1 * | 1/2004 | Hullett | ..... | 89/45 |
| 6,742,436 | B2 | 6/2004 | Grange et al. | | |
| 7,159,504 | B2 * | 1/2007 | Heldmann et al. | ..... | 89/45 |
| 2003/0140776 | A1 * | 7/2003 | Domeij | ..... | 89/47 |
| 2004/0083881 | A1 * | 5/2004 | Panek et al. | ..... | 89/46 |
| 2005/0022659 | A1 * | 2/2005 | Domeij | ..... | 89/45 |
| 2006/0162541 | A1 * | 7/2006 | Heldmann et al. | ..... | 89/45 |
| 2007/0151493 | A1 | 7/2007 | Graf et al. | | |

FOREIGN PATENT DOCUMENTS

| | | |
|---|---|---|
| EP | 0 051 119 | 2/1982 |
| EP | 0 331 980 | 9/1989 |
| WO | WO 2004/048878 | 6/2004 |

* cited by examiner

*Primary Examiner*—Troy Chambers
*Assistant Examiner*—Samir Abdosh
(74) *Attorney, Agent, or Firm*—Robert W. Becker; Robert Becker & Assoc

(57) ABSTRACT

A large-caliber gun integrated into a military ship and mounted with the turret and the weapons system of an armored howitzer. Disposed below the turret body portion is a shell magazine in which is installed a shell transporter that grasps the shells and supplies them to a shell-raising mechanism, by means of which the shells are conveyed from the shell magazine into the turret body portion. A shell transfer arm, pivotably mounted on the trunnion of the weapon, carries at one end a charger that in the raised position of the shell transfer arm is aligned with the gun bore axis of the weapon, and in the lowered position is aligned with the direction of movement of the shell-raising mechanism. The shells are introduced from the shell-raising mechanism directly into the charger and after pivoting-up of the shell transferring arm are supplied to the weapon.

6 Claims, 4 Drawing Sheets

1
2
1.1
5.2
3
3.1
7.22
7
7.1
4
5.1
7.21
7.3

5.2
3
3.1
7.22

LARGE-CALIBER GUN INTEGRATED INTO A MILITARY SHIP

The instant application should be granted the priority date of 5 Sep. 2006, the filing date of the corresponding German patent application DE 10 2006 041 602.3.

BACKGROUND OF THE INVENTION

The present invention relates to a large-caliber gun that is integrated into a military ship and is mounted with the turret and the weapon system of an armored howitzer, wherein the turret, which is pivotable in azimuth and in which the weapon that can be aimed in elevation is disposed, is connected with the hull of the ship via a shock-absorbing mounting means, wherein below the turret is disposed a turret body portion into which a shell transfer arm, which is pivotably mounted on a trunnion of the weapon, is adapted to be pivoted, and wherein a charger is disposed on a free end of the shell transfer arm in such a way that in a raised position of the shell transfer arm the charger is aligned with the gun bore axis of the weapon.

Such an arrangement is known and is described, for example, in DE 10 254 786 A1 and WO 2004/048878 A1. A known armored howitzer is described in EP 0 331 980 A1.

It is an object of the present invention to improve a large-caliber gun that is integrated into a military ship and that has the aforementioned features in such a way that a fully automatic transport of the shells from a shell magazine into the region behind the weapon is possible, whereby the arrangement should be as space-saving as possible and with which a rapid and smooth munition flow is to be achieved.

BRIEF DESCRIPTION OF THE DRAWINGS

This object, and other objects and advantages of the present application, will appear more clearly from the following specification in conjunction with the accompany schematic drawings, which show one exemplary embodiment of a large-caliber gun that is integrated into a military ship, for describing the procedure for delivering the shells from the shell magazine into the loading position. The drawings show.

SUMMARY OF THE INVENTION

Figure 1:
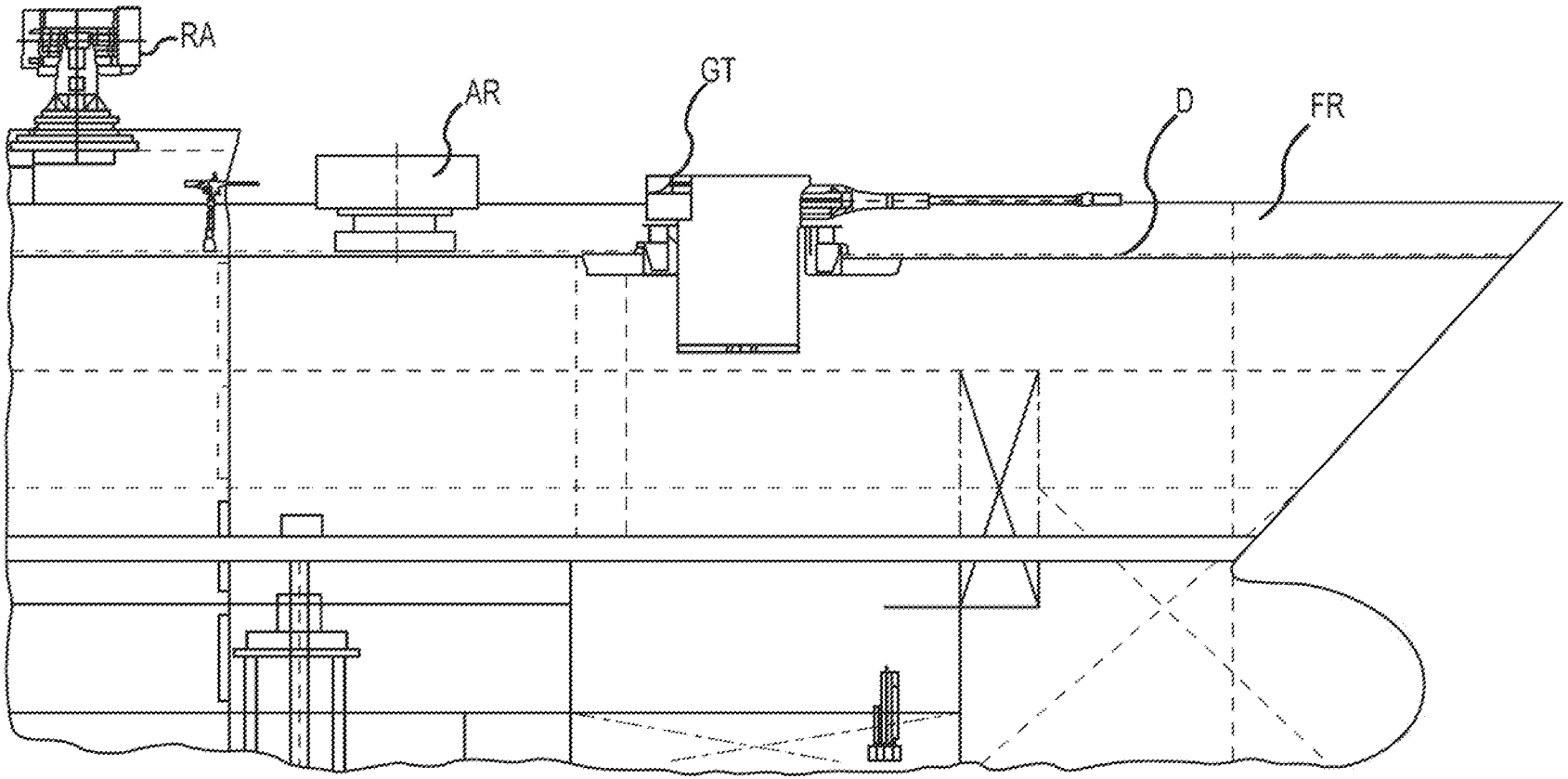
FIG. 1 a longitudinal cross-sectional illustration of a portion of a military ship having a large-caliber gun integrated into the ship.

The object of the present application is realized by a large-caliber gun comprising a shell magazine disposed below the turret body portion, wherein shells are adapted to be disposed in the shell magazine such that they are perpendicular to the base of the magazine while leaving free a passageway; a shell transporter disposed in the passageway and provided with a transport arm, which is pivotable at least about a vertical axis, and a pivotable grasping device disposed on the free end of the transport arm; and a shell-raising mechanism, wherein proceeding from the shell magazine in a direction perpendicular to the base of the magazine, the shell-raising mechanism extends into the turret body portion, wherein for receiving a shell delivered by the shell transporter, the shell-raising mechanism is provided with at least one lifting plate that is movable perpendicular to the base of the magazine and is disposed on a conveying element that is adapted to be driven by a motor, and wherein the shell transfer arm and the shell-raising mechanism are disposed relative to one another such that when the shell transfer arm is pivoted down into the turret body portion, the charger is aligned with a direction of movement of the lifting plate of the shell-raising mechanism in such a way that a shell disposed on the lifting plate is adapted to be introduced directly into the charger, which is provided with a shell-supporting mechanism; and drive and control devices for movement of the shell transporter, the shell-raising mechanism, and the shell transfer arm.

A basic concept of the present invention is to adopt some features from the known armored howitzer for a gun integrated into a military ship, and to supplement these features with further features and on the whole to adapt them so as to obtain an overall solution that is optimized for use on a ship.

Due to the special space conditions of a ship, the shell magazine is disposed considerably lower than is the case with the known armored howitzer, namely below the turret body portion. For this reason, several features of the shell delivery apparatus of the known armored howitzer have to be eliminated, namely the stand-by member, which is pivotable upwardly about a horizontal axis, into which the shells are placed by the shell transporter, and from which the shells are transferred directly into the charger of the shell transfer arm. In contrast, with the inventive approach the shells are delivered by the shell transporter to a shell-raising mechanism, by means of which they are conveyed from the low-lying shell magazine into the turret body portion, and from there are introduced directly into the charger of the pivoted-up shell transfer arm. In this way, it is possible to achieve a very rapid and smooth, fully automatic transport of the shells from the shell magazine into the region behind the weapon. The entire shell transport from the shell magazine into the loading position can be effected automatically, controlled by electronic control devises that are know per se. In this connection, for example, the position coordinates of the shells in the shell magazine, and further shell data, can be stored a known manner in a munitions flow logic, so that already upon actuation of the shell transporter, the position of given shells can be selected.

Further specific features of the present invention will be described in detail subsequently.

DESCRIPTION OF SPECIFIC EMBODIMENTS

Referring now to the drawings in detail, the very schematic illustration of FIG. 1 shows a portion of the hull FR of a military ship, for example a frigate having a ship deck D, a large-caliber gun that is integrated into the ship hull and is mounted with the turret GT and the weapon system of an armored howitzer, as well as further apparatus, such as an artillery rocket firing device AR and a position-finding RA.

Figure 2:
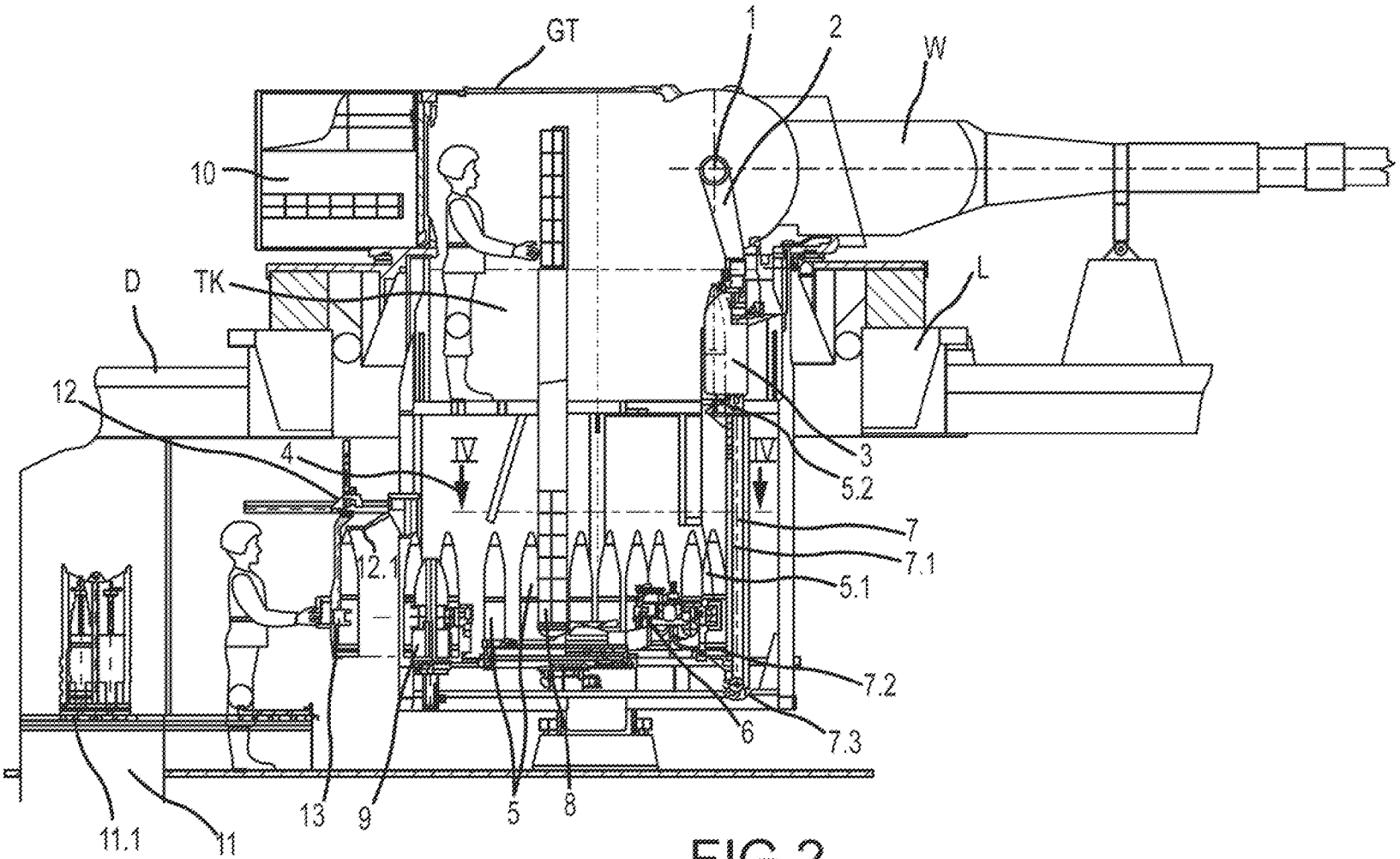
FIG. 2 an enlarged longitudinal cross-sectional view of the gun of FIG. 1.

The detailed illustration of FIG. 2 shows the gun integrated into the ship hull. The turret GT of the gun is disposed on the upper deck D of the hull and is connected with the hull via a shock-absorbing mounting means L. This mounting means L, which is known per se, is not explained in detail in the following, wherein for details thereof reference is made to the previously cited publications. The weapon W, which can be aimed in elevation, is disposed in the turret GT. Pivotably mounted in a known manner on the trunnion 1 of the weapon is a shell transfer arm 2, on the free end of which is disposed a loading element or charger 3 for shells. The arrangement is such that when the shell transfer arm 2 is in the non-illustrated raised position, the charger 3 is aligned with the gun bore axis of the weapon, whereas in the lowered state of the shell transfer arm 2, as illustrated in FIG. 2, the charger 3 is oriented perpendicular to the base of the turret body portion TK that is disposed below the turret GT.

Figure 4:
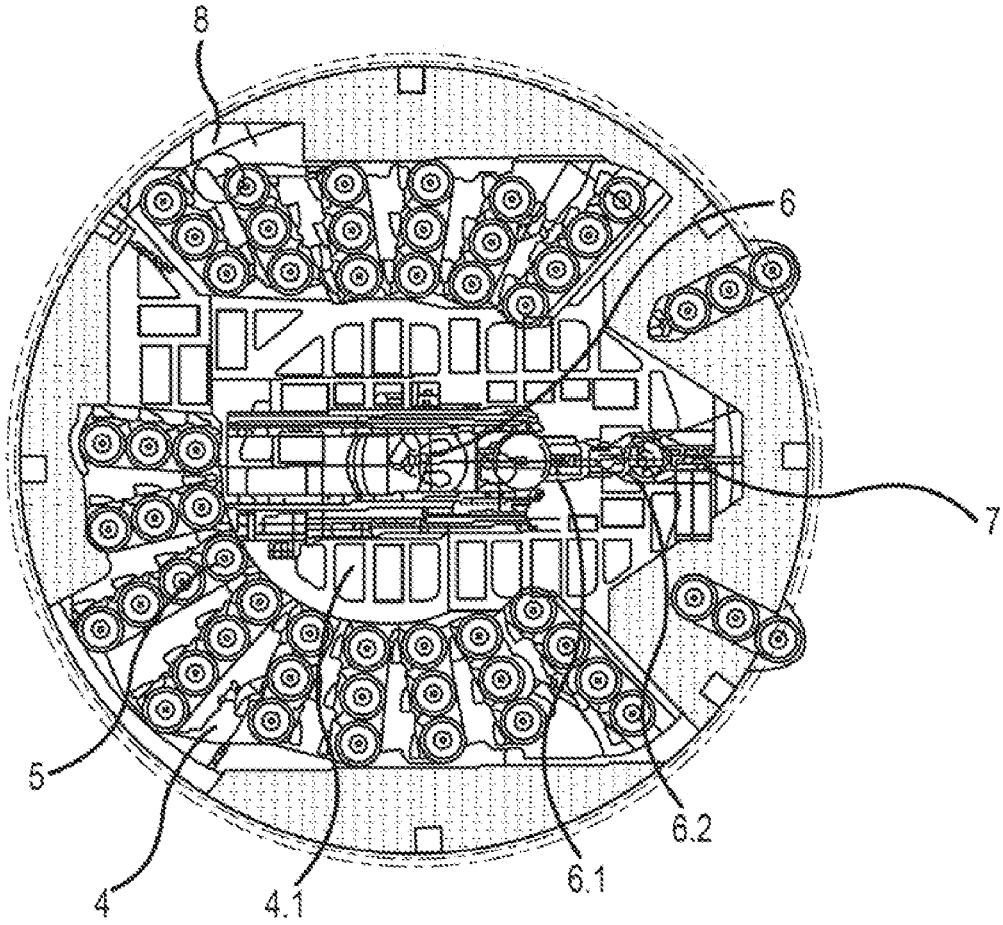
FIG. 4 a plan view of the shell magazine of the gun of FIG. 2.

Disposed below the turret body portion TK is a shell magazine 4 in which shells, which are generally designated by the reference numeral 5, are disposed upright relative to the base of the magazine, and in particular in such a way that, as shown in FIG. 4, a passageway 4.1 is left free between the shells 5, which are aligned in essentially radial rows. Disposed in this passageway 4.1 is a shell transporter 6 that is provided with a transport arm 6.1, which is pivotable at least about a vertical axis and on the end of which is disposed a pivotable grasping device 6.2. Such a shell transporter is known and is described, for example, in EP 0 331 980 A1.

To enable a smooth flow of munition from this low-lying shell magazine 4 into the region behind the weapon 4, a shell-raising mechanism 7 is provided that, proceeding from the shell magazine 4 in a vertical direction relative to the base of the magazine, extends into the turret body portion TK. This shell-raising mechanism 7 has a conveying element 7.1, which is embodied as a chain that is rigid toward the back, and on which is disposed a lifting plate, which in FIG. 2 is designated by the reference numeral 7.2. The lifting plate 7.2 can be moved upwardly and back again, in a direction perpendicular to the base of the magazine, by means of the conveying element 7.1, which is driven by a drive motor 7.3.

Figures 3, 3A:
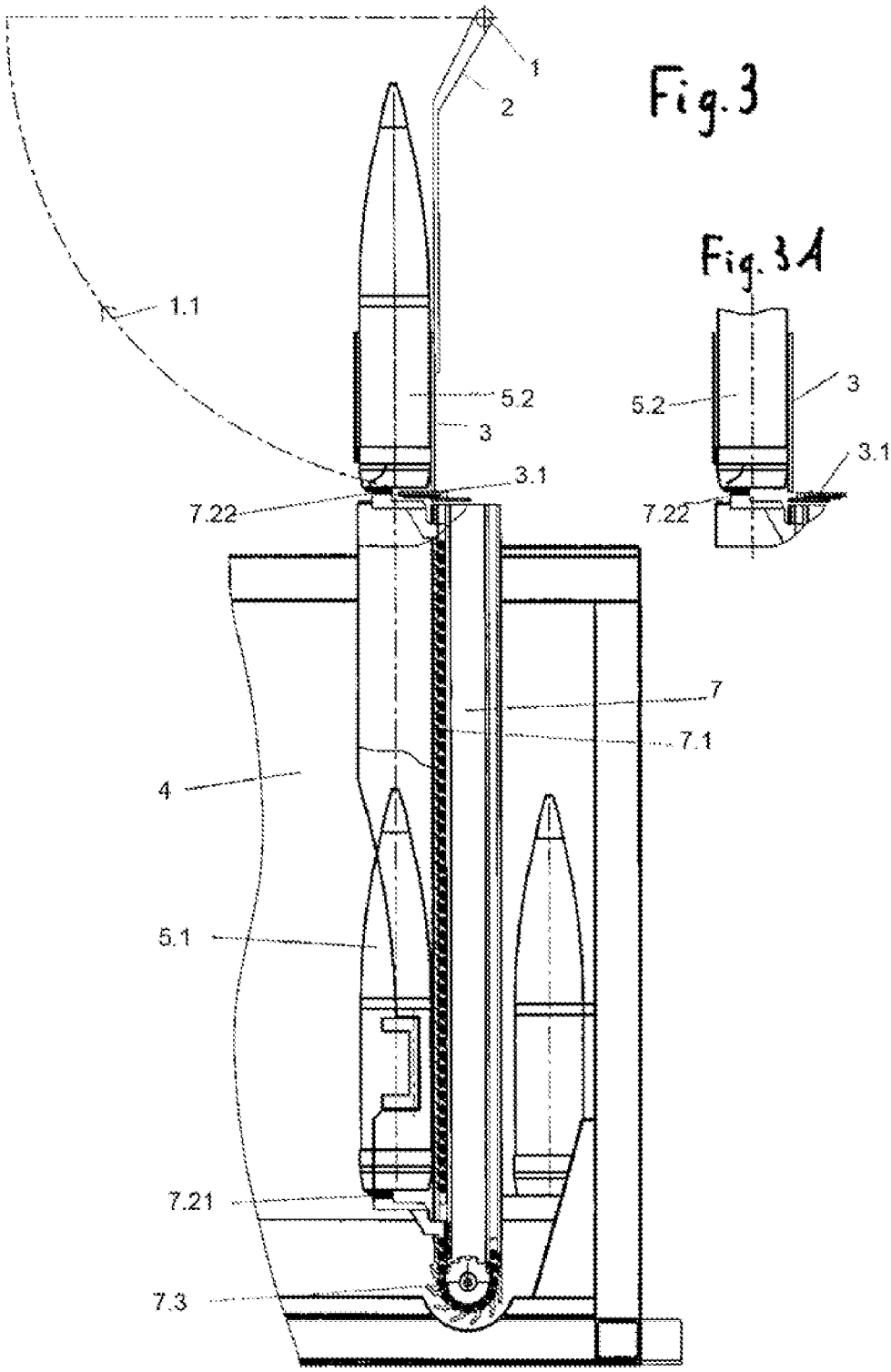
FIG. 3 a further enlarged partial illustration of the charger and the shell-raising mechanism of the gun of FIG. 2.
FIG. 3A in an illustration analogous to FIG. 3 a portion of the charger and of the shell-raising mechanism in a phase of the shell-delivery process altered relative to FIG. 3.

A more accurate manner of functioning of the shell-raising mechanism 7 can be seen from FIGS. 3 and 3A, which simultaneously illustrate different phases with regard to the functioning of the shell-raising mechanism 7 in conjunction with the charger 3 of the shell transfer arm 2. For example, in FIG. 3 the lifting plate 7.2 is designated in its lower position within the shell magazine 4 by the reference numeral 7.21, whereas its upper position within the turret body portion TK it is designated by the reference numeral 7.22.

In the lower position 7.21 of the lifting plate, a shell 5.1 is placed thereon, is conveyed upwardly by means of the shell-raising mechanism 7, and is introduced into the charger 3 of the shell transfer arm 2. In the upper position of the lifting plate, which is designated by the reference numeral 7.22, the shell has the reference numeral 5.2.

In the pivoted-down position of the shell transfer arm 2, the charger 3 is aligned with the direction of movement of the lifting plate 7.2 and 7.22.

A more precise configuration of the charger 3 and of the lifting plate 7.21 or 7.22 are described in the following for enabling conveyance of the shell into the charger 3 and the securing of the shell in the charger 3 for a further pivoting up into the region behind the weapon.

The lifting plate 7.21 or 7.22 of the shell-raising mechanism 7 is embodied as a first plate half on which is supported a portion of the base of the shell 5.1 or 5.2. As a shell-supporting mechanism the charger 3 has a second plate half 3.1, which is embodied essentially complementarily to the lifting plate that is formed as a first plate half. The second plate half 3.1 is pivotable, about a pivot axis that extends parallel to the longitudinal axis of the charger 3, out of an open position (illustrated in FIG. 3 A) into a closed position (illustrated in FIG. 3). In the open position, the base of the shell 5.2 is supported merely by the lifting plate 7.22. In this position, the shell 5.2, during its upward movement, can be introduced in an unobstructed manner into the charger 3. As soon as the shell 5.2 is in the charger 3, the plate half 3.1 of the shell-supporting mechanism pivots out of the open position (FIG. 3A) into the closed position (FIG. 3). In this position, the base of the shell 5.2 is supported not only by the lifting plate 7.22 but also by the plate half 3.1 of the shell-supporting mechanism. The lifting plate can now be moved back downwardly with the shell 5.2 being held securely in place in the charger 3. The shell transfer arm 2 can now be pivoted upwardly in the direction 1.1 about the trunnion 1 into the non-illustrated position behind the weapon in which the longitudinal axis of the charger 3 is aligned with the gun bore axis of the weapon W.

The delivery of the shell 5.1 to the lifting plate 7.2 disposed in the lower position is effected in a known manner in that the shell transporter (FIG. 4), by means of the grasping device 6.2, grasps a shell 5 from the shell magazine 4, moves it in the direction toward the shell-raising mechanism 7, and places it upon the lifting plate 7.21 in the lower position.

In the illustrated embodiment, a propellent charge conveying device 8 is furthermore provided that, proceeding from the shell magazine 4 parallel to the shell-raising mechanism 7 and in a direction perpendicular to the base of the magazine, extends into the turret body portion TK. By means of the conveying device 8, propellent charges disposed in an additional propellent charge magazine disposed below the turret body portion can be conveyed into the turret body portion.

Furthermore propellent charges can be stored in a propellent charge magazine 10 disposed on the turret GT.

Additionally disposed in the shell magazine 4 is a loading device 9, by means of which the shells can be supplied to the shell magazine 4 from the side or can be withdrawn therefrom.

The shells that are to be supplied to the shell magazine 4 are conveyed from a non-illustrated munitions bunker, which is disposed at a lower level of the ship, to the level of the shell magazine 4 by means of a munitions hoist (FIG. 2). The shells are disposed on a carriage 11.1 that can be moved toward the shell magazine 4 on a guideway or track. The shells are then removed from the carriage 11.1 by an operator via a shell grasping device 13, which is disposed on an apparatus having a lifting device 12, and the shells are supplied to the loading device 9 by means of the lifting device. The shells are removed from the loading device 9 by means of the shell transporter 6, and are delivered to their deposit locations in the shell magazine 4. Unloading of the shell magazine 4 is possible in the reverse sequence of these steps. Since with all of the grasping and transfer steps unforeseen movements of the ship can occur, care must be taken that in particular the heavy shells cannot undergo an uncontrolled movement. For this reason, the movement apparatus having the lifting device 12 is provided with a brake lever 12.1 by means of which the lifting device and the shell are instantly secured in place if, for example, due to a movement of the ship the operator lets go of the manually operable shell grasping device 13.

The specification incorporates by reference the disclosure of German priority document DE 10 2006 041 602.3 filed 5 Sep. 2006.

The present invention is, of course, in no way restricted to the specific disclosure of the specification and drawings, but also encompasses any modifications within the scope of the appended claims.

What I claim is:

1. A large-caliber gun that is integrated into a military ship and is mounted with the turret and the weapon system of an armored howitzer, wherein the turret, which is pivotable in azimuth and in which the weapon that can be aimed in elevation is disposed, is connected with the hull of the ship via a shock-absorbing mounting means, wherein below the turret is disposed a turret body portion into which a shell transfer arm, which is pivotably mounted on a trunnion of the weapon, is adapted to be pivoted, and wherein a charger is disposed on a free end of said shell transfer arm in such a way that in a raised position of said shell transfer arm said charger is aligned with a gun bore axis of the weapon, said large-caliber gun comprising:

a shell magazine disposed below the turret body portion, wherein shells are adapted to be disposed in said shell magazine such that they are perpendicular to a base of the magazine while leaving free a passageway;

a shell transporter disposed in said passageway, wherein said shell transporter is provided with a transport arm, which is pivotable at least about a vertical axis, and a pivotable grasping devise disposed on a free end of said transport arm;

a shell-raising mechanism, wherein proceeding from said shell magazine in a direction perpendicular to the base of the magazine, said shell-raising mechanism extends into the turret body portion, wherein for receiving a shell delivered by said shell transporter, said shell-raising mechanism is provided with at least one lifting plate that is movable perpendicular to the base of the magazine and is disposed on a conveying element that is adapted to be driven by motor, and wherein said shell transfer arm and said shell-raising mechanism are disposed relative to one another such that when said shell transfer arm is pivoted down into the turret body portion, said charger is aligned with a direction of movement of said lifting plate of said shell-raising mechanism in such a way that a shell disposed on said lifting plate is adapted to be introduced directly into said charger, which is provided with a shell-supporting mechanism;

drive and control devices for movement of said shell transporter, said shell-raising mechanism and said shell transfer arm;

a propellent charge magazine disposed below the turret body portion; and a propellent charge conveying device that, proceeding from said shell magazine in a direction perpendicular to the base of the magazine, extends into the turret body portion.

2. A gun according to claim 1, wherein said conveying element is embodied as a chain that is rigid toward a back side.

3. A large-caliber according to claim 1, gun that is integrated into a military ship and is mounted with the turret and the weapon system of an armored howitzer, wherein the turret, which is pivotable in azimuth and in which the weapon that can be aimed in elevation is disposed, is connected with the hull of the ship via a shock-absorbing mounting means, wherein below the turret is disposed a turret body portion into which a shell transfer arm, which is pivotably mounted on a trunnion of the weapon, is adapted to be pivoted, and wherein a charger is disposed on a free end of said shell transfer arm in such a way that in a raised position of said shell transfer arm said charger is aligned with a gun bore axis of the weapon, said large-caliber gun comprising:

a shell magazine disposed below the turret body portion, wherein shells are adapted to be disposed in said shell magazine such that they are perpendicular to a base of the magazine while leaving free a passageway;

a shell transporter disposed in said passageway, wherein said shell transporter is provided with a transport arm, which is pivotable at least about a vertical axis, and a pivotable grasping devise disposed on a free end of said transport arm;

a shell-raising mechanism, wherein proceeding from said shell magazine in a direction perpendicular to the base of the magazine, said shell-raising mechanism extends into the turret body portion, wherein for receiving a shell delivered by said shell transporter, said shell-raising mechanism is provided with at least one lifting plate that is movable perpendicular to the base of the magazine and is disposed on a conveying element that is adapted to be driven by motor, and wherein said shell transfer arm and said shell-raising mechanism are disposed relative to one another such that when said shell transfer arm is pivoted down into the turret body portion, said charger is aligned with a direction of movement of said lifting plate of said shell-raising mechanism in such a way that a shell disposed on said lifting plate is adapted to be introduced directly into said charger, which is provided with a shell-supporting mechanism; and drive and control devices for movement of said shell transporter, said shell-raising mechanism and said shell transfer arm, wherein said lifting plate of said shell-raising mechanism is embodied as a first plate half, further wherein said charger is provided at a rear end, as said shell-supporting mechanism, with a second plate half that is embodied essentially complementarily to said first plate half, and wherein said second plate half is adapted to be pivoted out of an open position in which said shell can be introduced into said charger, into a closed position in which said second plate half, beneath a base of the shell, is pivoted into a region freed by said lifting plate.

4. A gun according to claim 3, wherein said second plate half of said shell-supporting mechanism is adapted to be pivoted out of the open position into the closed position about a pivot axis that extends parallel to a longitudinal axis of said charger.

5. A gun according to claim 1, wherein a shell placement mechanism is disposed on said charger.

6. A gun according to claim 1, wherein a loading device is disposed within said shell magazine.

* * * * *

UNITED STATES PATENT AND TRADEMARK OFFICE

CERTIFICATE OF CORRECTION

PATENT NO. : 7,849,782 B2
APPLICATION NO. : 11/850203
DATED : December 14, 2010
INVENTOR(S) : Heinrich Heldmann It is certified that error appears in the above-identified patent and that said Letters Patent is hereby corrected as shown below:

Col. 5 lines 46-47
Claim 3 currently reads, "A large-caliber according to claim 1, gun that is integrated into a military ship..."

Claim 3 should read "A large-caliber gun that is integrated into a military ship..."

Signed and Sealed this
First Day of March, 2011

David J. Kappos

David J. Kappos
*Director of the United States Patent and Trademark Office*